US007264413B2

(12) United States Patent
Vosbikian et al.

(10) Patent No.: US 7,264,413 B2
(45) Date of Patent: Sep. 4, 2007

(54) MOPS WITH ONE OR MORE CLEANING MEMBERS

(75) Inventors: Peter S. Vosbikian, Moorestown, NJ (US); Robert E. Petner, Burlington, NJ (US)

(73) Assignee: Quickie Manufacturing Corporation, Cinnaminson, NJ (US)

( * ) Notice: Subject to any disclaimer, the term of this patent is extended or adjusted under 35 U.S.C. 154(b) by 0 days.

(21) Appl. No.: 10/602,908

(22) Filed: Jun. 24, 2003

(65) Prior Publication Data

US 2004/0265037 A1 Dec. 30, 2004

(51) Int. Cl.

| | |
|---|---|
| ***A47L 13/26*** | (2006.01) |
| ***A47L 1/08*** | (2006.01) |
| ***A47L 13/12*** | (2006.01) |
| ***A47L 13/14*** | (2006.01) |

(52) U.S. Cl. ..... 401/139; 401/137; 401/27; 401/25; 15/116.2

(58) Field of Classification Search ..... 401/137, 401/138, 139, 192, 206, 263, 265, 266, 270, 401/279, 278, 287, 288, 25, 27; 15/119.2, 15/116.1, 116.2, 119.1

See application file for complete search history.

(56) References Cited

U.S. PATENT DOCUMENTS

| | | | | | |
|---|---|---|---|---|---|
| 438,218 | A | * | 10/1890 | Ziv et al. | 401/279 |
| 1,618,930 | A | * | 2/1927 | Istrico | 401/138 X |
| 2,254,487 | A | | 9/1941 | McCune | |
| 2,261,411 | A | | 11/1941 | Rees | |
| 2,262,334 | A | | 11/1941 | Rugaard | |
| 2,301,586 | A | | 11/1942 | Rubin | |
| 2,304,257 | A | * | 12/1942 | Jilbert | 222/554 |
| 2,551,776 | A | * | 5/1951 | Waltz | 401/139 |
| 2,855,620 | A | * | 10/1958 | Jones | 401/139 |
| 2,891,270 | A | | 6/1959 | Reiter | |
| 2,919,457 | A | | 1/1960 | Cole | |
| 3,014,230 | A | | 12/1961 | Morgan | |
| 3,161,905 | A | | 12/1964 | Dryden | |
| 3,199,136 | A | | 8/1965 | George | |
| 3,402,009 | A | * | 9/1968 | Sawyer | 401/266 |
| 3,465,377 | A | | 9/1969 | Thomas | |
| 3,552,870 | A | * | 1/1971 | Brooks | 401/206 |
| 3,760,450 | A | | 9/1973 | Griffin et al. | |
| 3,792,505 | A | | 2/1974 | Saltzstein | |
| 4,184,224 | A | | 1/1980 | Joffre | |
| 4,748,710 | A | | 6/1988 | Jones | |
| 4,750,233 | A | | 6/1988 | Swain | |
| 4,793,019 | A | | 12/1988 | Stima et al. | |
| 4,852,210 | A | | 8/1989 | Krajicek | |
| 4,945,599 | A | | 8/1990 | Flynn | |
| 4,971,471 | A | | 11/1990 | Sloan | |

(Continued)

*Primary Examiner*—David J. Walczak
(74) *Attorney, Agent, or Firm*—Thomas J. Ring; Wildman, Harrold, Allen & Dixon LLP

(57) ABSTRACT

Mops comprising one or more cleaning members. In select embodiments, the cleaning members are releasably secured to the mop and may be capable of compression. In these embodiments, the different cleaning members enable the mop to operate in a plurality of different modes, including a wringing mop mode, a damp mop mode and a dust mop mode. In other embodiments, a portion of the handle of the mop is adapted to hold and release a fluid, such as a cleaning solution. In these embodiments, the user may cause release of the fluid through one or more openings associated with the mop.

49 Claims, 11 Drawing Sheets

U.S. PATENT DOCUMENTS 5,071,489 A 12/1991 Silvenis et al.
5,530,982 A 7/1996 Specht
5,865,551 A * 2/1999 Lalli et al. ..... 401/139
5,888,006 A 3/1999 Ping et al.
5,960,508 A 10/1999 Holt et al.
5,979,004 A * 11/1999 Wilson ..... 15/119.2
5,988,920 A 11/1999 Kunkler et al.
6,003,191 A 12/1999 Sherry et al.
6,048,123 A 4/2000 Holt et al.
6,101,661 A 8/2000 Policicchio et al.
6,142,750 A 11/2000 Benecke
6,260,226 B1 7/2001 Specht
6,497,525 B1 * 12/2002 Huang ..... 401/138
6,540,424 B1 4/2003 Hall et al.
6,854,150 B2 * 2/2005 Hirse ..... 15/119.2
6,865,768 B2 * 3/2005 Chen ..... 15/115
2001/0006589 A1 * 7/2001 Fodrocy et al. ..... 401/137 X
2002/0162573 A1 11/2002 Fernandez
2002/0174502 A1 11/2002 Cioci
2002/0184726 A1 12/2002 Kingry et al.
2003/0035679 A1 * 2/2003 Zorzo ..... 401/138

* cited by examiner

MOPS WITH ONE OR MORE CLEANING MEMBERS

FIELD OF THE INVENTION

This invention relates to mops, and more particularly to mops comprising one or more cleaning members. The present invention further relates to mops adapted to hold and release a fluid.

SUMMARY OF THE INVENTION

Mops comprising various features are disclosed.

In one embodiment, the mop of the present invention comprises a handle, including an upper end and a lower end, a mop head disposed near the lower end of the handle, the mop head adapted for releasable securement of a first cleaning member, a second cleaning member adapted to be releasably secured to the mop head in the absence of the first cleaning member and an actuator associated with the mop to cause the mop head to compress a portion of at least one of the first and second cleaning members.

In another embodiment, the mop of the present invention comprises a handle including an upper end and a lower end, a mop head disposed near the lower end of the handle and an actuator adapted to cause compression of a portion of a cleaning member, in which the cleaning member is releasably secured to the mop head. Mops constructed according to this embodiment are capable of operating in one of a first mode in which the cleaning member is constructed of a sponge-like material, a second mode in which a pre-moistened cleaning member is secured to the mop head, and a third mode in which a dry cleaning member is secured to the mop head.

In yet another embodiment, the mop of the present invention comprises a handle including an upper end, a lower end and a portion adapted to hold a fluid, a mop head disposed near the lower end of the handle, the mop head including a cleaning member, one or more openings in communication with the portion of the handle adapted to hold the fluid, a first actuator associated with the mop to cause the mop head to compress a portion of the first cleaning member and a second actuator adapted to cause the fluid to be released through the one or more openings.

In still another embodiment, the mop of the present invention comprises a handle including an upper end and a lower end and a portion adapted to hold a fluid, a mop head disposed near the lower end of the handle, the mop head including a cleaning member, one or more openings in communication with the portion of the handle adapted to hold the fluid, a valve assembly within the handle for releasing the fluid from the opening in the portion of the handle, the valve assembly including a valve that, in a closed position, covers the opening in the portion of the handle, wherein the valve is movable to an open position to uncover the opening.

In still another embodiment, the mop of the present invention comprises a handle including an upper end, a lower end and a portion adapted to hold a fluid; wherein the portion adapted to hold the fluid does not include a removable container, an opening disposed in the upper end for pouring fluid into the handle, a mop head disposed near the lower end of the hollow handle, the mop head including a cleaning member and one or more openings in communication with the portion of the handle adapted to hold the fluid, the one or more openings capable of releasing the fluid.

BRIEF DESCRIPTION OF THE DRAWINGS

Certain embodiments of the presently claimed invention are illustrated by the accompanying figures. It should be understood that the figures are not necessarily to scale and that details which are not necessary for an understanding of the invention or which render other details difficult to perceive may be omitted. It should be understood, of course, that the invention is not necessarily limited to the particular embodiments illustrated herein.

DETAILED DESCRIPTION

The present invention relates to mops comprising one or more cleaning members. In select embodiments, a plurality of cleaning members may be releasably secured to the mop and a portion of the cleaning members may be capable of compression. In these embodiments, the different cleaning members enable the mop of the present invention to operate in a plurality of different modes, including a wringing mop mode, a damp mop mode and a dust mop mode. In other embodiments, a portion of the handle of the mop of the present invention is adapted to hold and release a fluid, such as a cleaning solution. In these embodiments, the user may cause release of the fluid through one or more openings associated with the mop.

Figure 1:
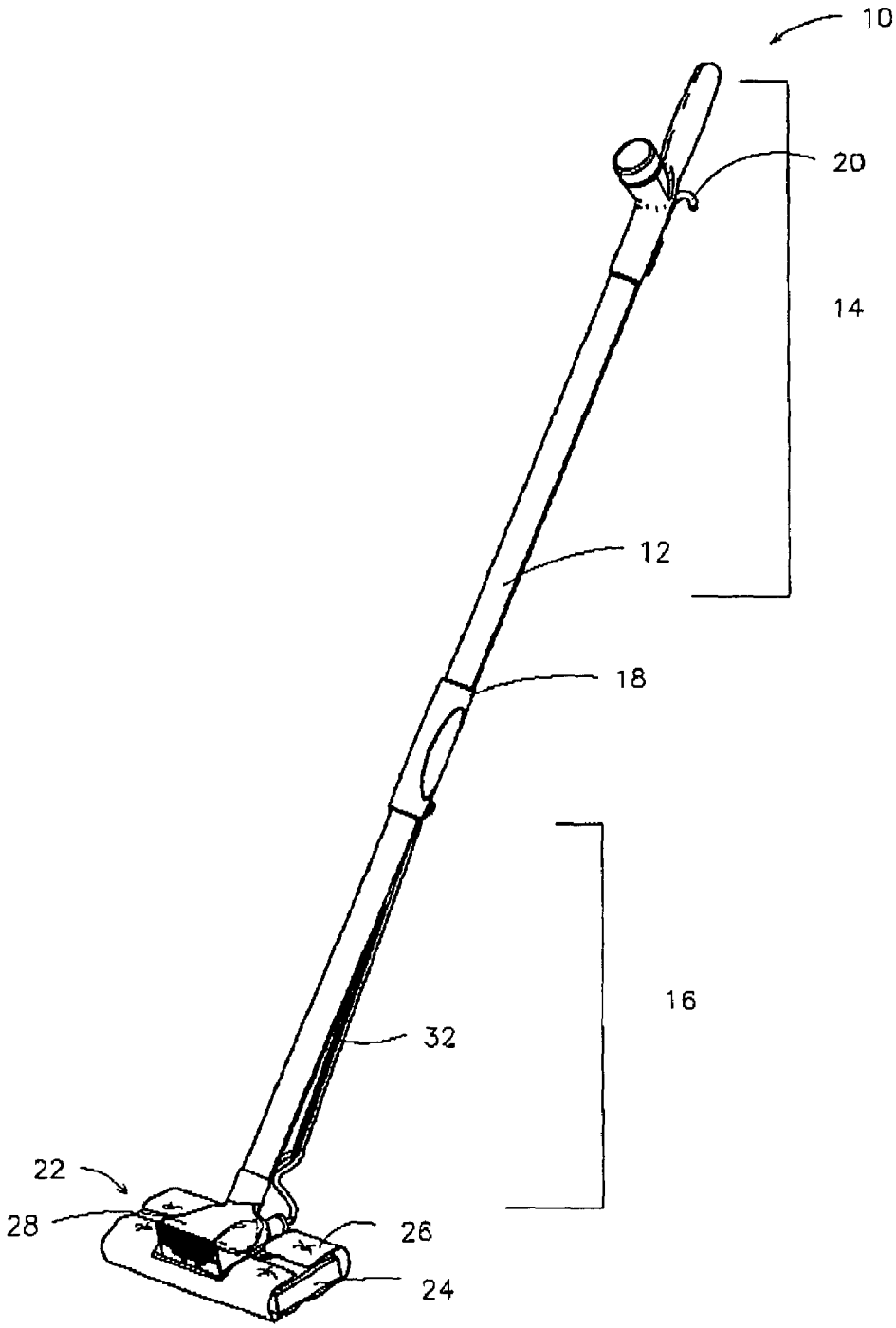
FIG. 1 is a perspective view of one embodiment of the mop of the present invention.

Referring now to FIG. 1, one embodiment of the mop 10 of the present invention is shown. Generally, this embodiment comprises a handle 12, which includes an upper end 14 and a lower end 16, a first actuator 18, a second actuator 20, a mop head 22, a first cleaning member 24, a second cleaning member 26, and a support member 28.

As shown in FIG. 1, the handle 12 comprises a first actuator 18. The first actuator 18 is any of various structures that may cause compression of a portion of the first and/or second cleaning members 24 and 26 or any other members attached thereto. In FIG. 1, the first actuator 18 is a hand grip that, when moved by manual force toward the lower end 16 of the handle 12, causes compression of a portion of the first and second cleaning members 24 and 26. Compression of a portion of the first and second cleaning members 24 and 26 in this manner may be used to release soil-carrying liquids from the mop 10.

In FIG. 1, the first actuator 18 is associated with a connector 32, which in turn, is associated with the mop head 22. The connector 32 may be disposed inside the handle 12 or co-extensively with the handle 12 in a parallel relationship, as seen in FIG. 1. The illustrated first actuator 18 and connector 32 are made of plastic and steel respectively, although various other materials known to those of skill in the art are suitable.

Figure 2:
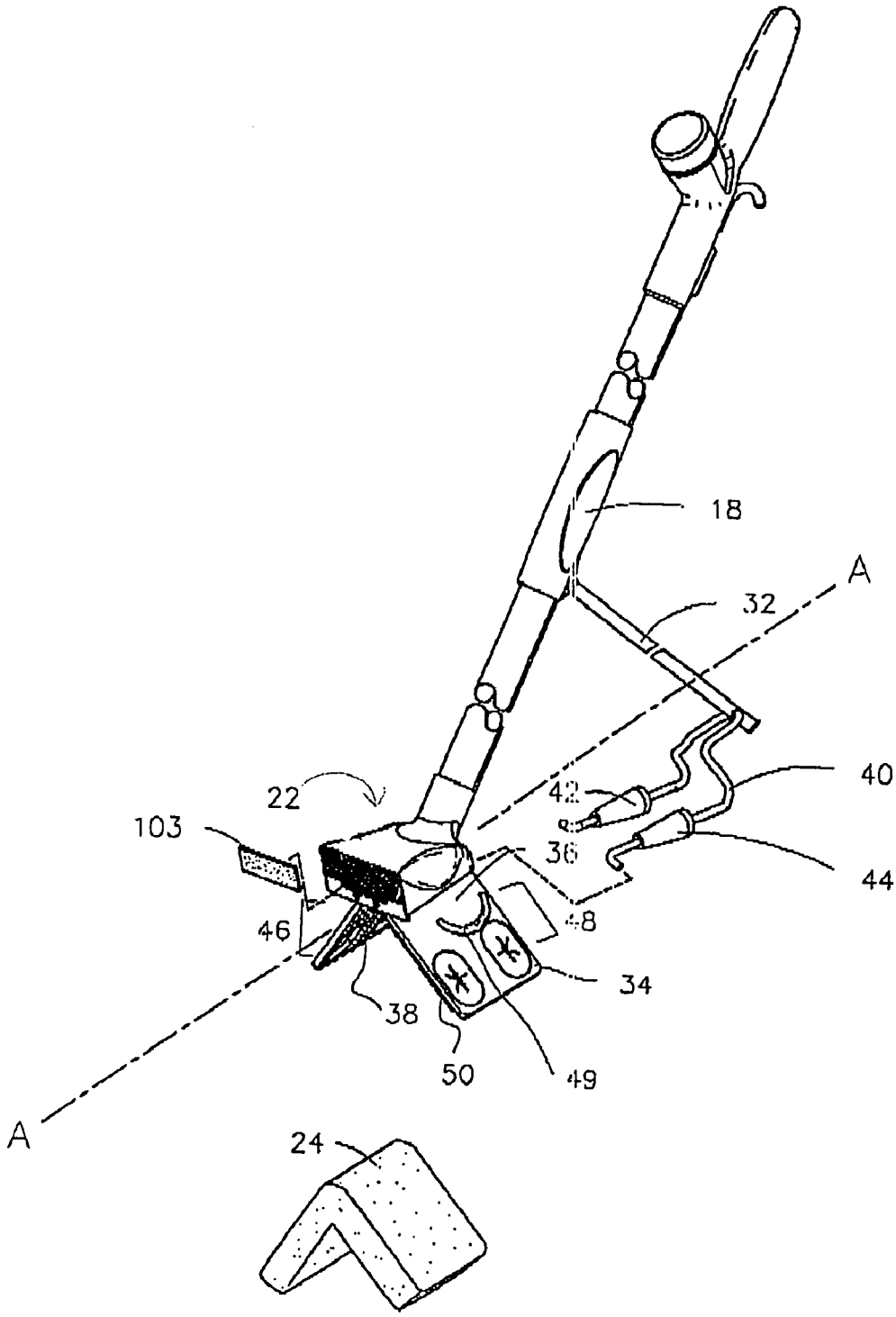
FIG. 2 is an exploded view of certain components of the mop of FIG. 1.

Many arrangements for causing compression of a portion of the first and second cleaning members 24 and 26 are suitable for purposes of the present invention. For example, in one embodiment, a so-called butterfly mop arrangement may be employed. As shown in FIG. 2, the mop head 22 comprises a hinged platen 34, which has a first side 36 associated with the handle 12 and a second side 38 associated with the first cleaning member 24. The first side 36 of the hinged platen 34 is also associated with the first actuator 18 through the connector 32. Attached to the connector 32 is a squeeze member 40 including a pair of opposing arms 42 and 44 positioned through an aperture in the connector 32.

The hinged platen 34 of this embodiment further comprises a support member 28 and a pair of opposing plates 46 and 48, rotatably secured about a common pivot access A. Manual force on the first actuator 18 toward the lower end 16 of the handle 12 rotates the opposing plates 46 and 48 about the common pivot axis A, thereby causing compression of a portion of the first and second cleaning members 24 and 26. Thus, the hinged platen 34 may be pivoted between a cleaning position in which the mop may be used to absorb soil and other debris and a compressed position for releasing soil-carrying liquids from the first and second cleaning members 24 and 26. Ramps 49 disposed on the first side 36 of the hinged platen 34 on either side of handle 12 may be used to facilitate rotation of the opposing plates 46 and 48 about the common pivot axis A through movement of the opposing arms 42 and 44 into the ramps 49.

Alternatively, the mop head 22 may comprise a pair of spaced apart roller members (not shown) associated with the first actuator 18 through the connector 32. As with the butterfly arrangement, manual force applied to the first actuator 18 causes compression of a portion of the first and second cleaning members 24 and 26. Most often, the roller members are positioned transverse to the handle 12 and are parallel, but not co-linear with one another. In one embodiment, each roller member comprises a single piece integral roller including three separate cylindrical segments, separated by cylindrical axle sections or undercuts of reduced diameters. The cylindrical axle sections or undercuts are provided so that the rollers may be engaged by extensions associated with the mop head 22.

In either of these embodiments, the mop head 22 can be provided in various shapes and sizes. The mop head 22 may also be configured for many different types of cleaning, such as cleaning walls, around corners, furniture and the like.

Figure 3:
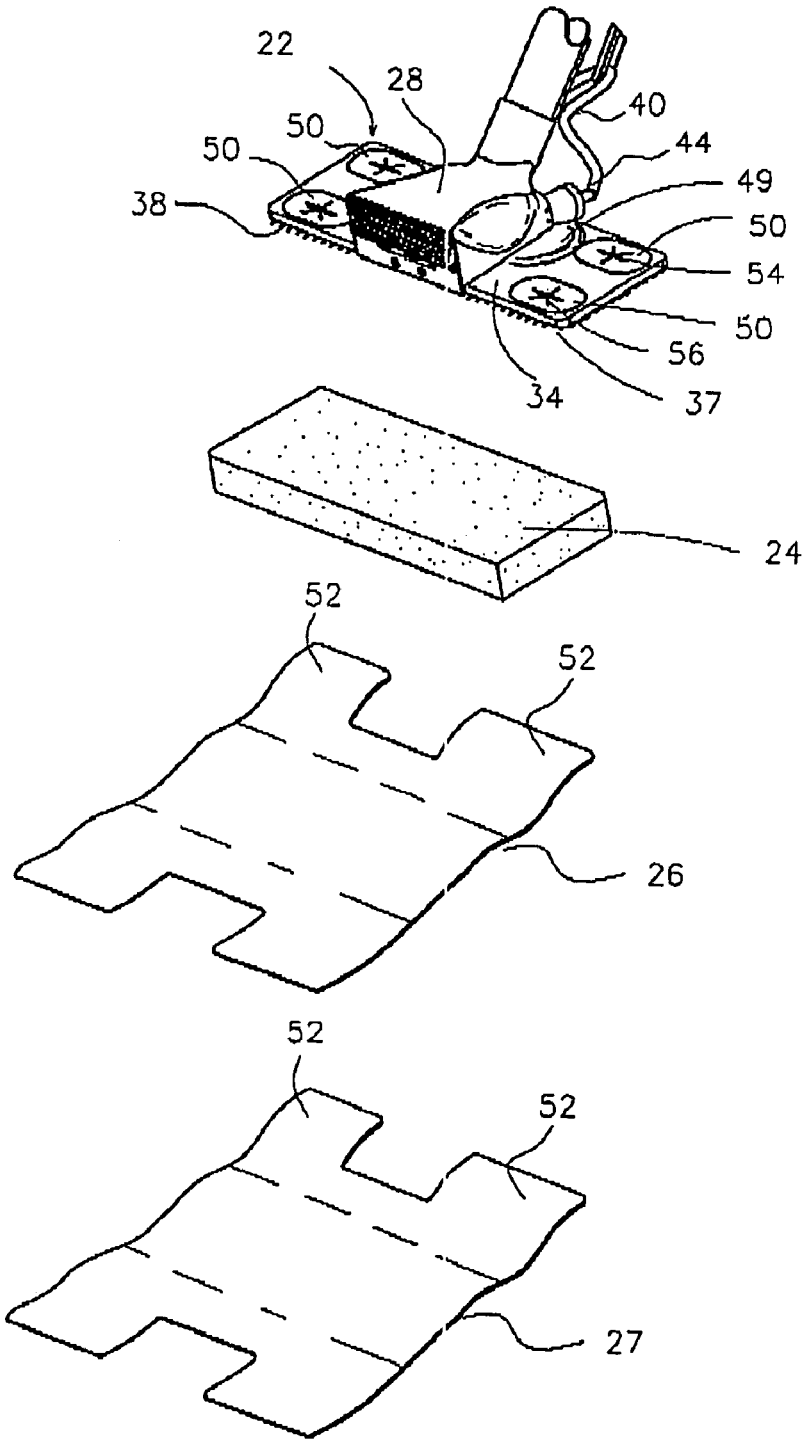
FIG. 3 is an exploded front perspective view of the mop head and cleaning members of one embodiment of the mop of the present invention.
Figure 4:
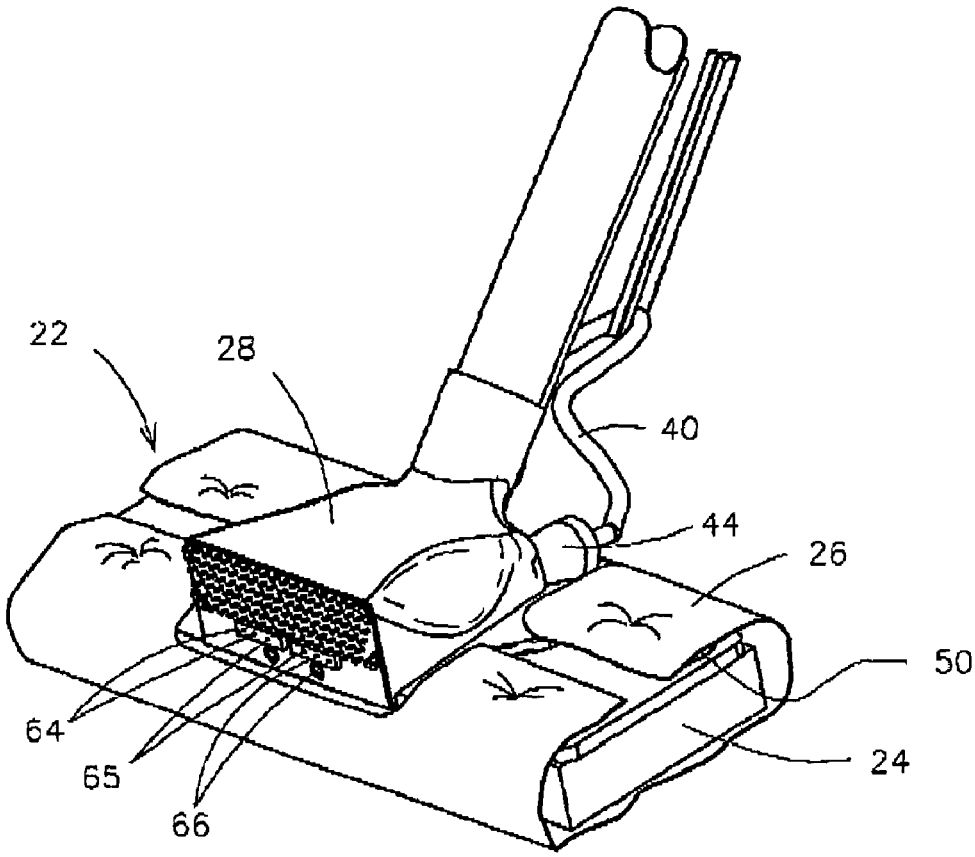
FIG. 4 is a perspective view of the mop head of one embodiment of the mop of the present invention with first and second cleaning members attached.

In accordance with another aspect of the present invention, one embodiment of the mop 10 comprises multiple cleaning members. In select embodiments, each of the cleaning members may be releasably secured to the second side 38 of the hinged platen 34. As shown in FIGS. 3 and 4, various cleaning members may be employed, including but not limited to the first cleaning member 24, the second cleaning member 26 and a third cleaning member 27. In one embodiment of the present invention, the first cleaning member 24 is constructed of a sponge-like material, the second cleaning member 26 is in the form of a dry sheet and the third cleaning member 27 is in the form of a pre-moistened sheet. Any of the first, second or third cleaning members 24, 26 and 27 may be releasably secured directly to the mop head. In addition, the second or third cleaning members 26 and 27 may be secured over the first cleaning member 24.

In embodiments where the first cleaning member 24 is constructed of a sponge-like material, a porous material is typically employed. For example, the first cleaning member may be constructed of cellulose, polyester, polyether or a blend thereof. As shown in FIG. 3, the first cleaning member 24 may be releasably secured to the hinged platen 34 through tiny hooks 37 extending from the second side 38 of the hinged platen 34. Additionally or alternatively, slides, clips and other attachments known to those of skill in the art may be employed to releasably secure the first cleaning member 24.

In embodiments where the second and third cleaning members 26 and 27 are constructed of a dry sheet or pre-moistened sheet, a cellulosic material is typically employed. Natural cellulosics, as well as synthetics like polyolefins (e.g. polyethylene and polypropylene), polyester, polyamides and blends thereof are suitable. Also useful are natural fibers, such as cotton or blends and those derived from various cellulosic sources. The pre-moistened sheet may be moistened by the manufacturer or by the user after purchase.

The inherent properties of the multiple cleaning members may vary. The cleaning members may, for example, be disposable, re-usable and even reversible. Further, the composition of each of the cleaning members may change, depending on the needs of the user.

In accordance with still another aspect of the present invention, shown in FIG. 3, mop head 22 comprises one or more securement structures 50 for releasably securing the second and third cleaning members 26 and 27 thereto. The first cleaning member 24 may also be configured to be releasably secured to the one or more securement structures 50. The one or more securement structures 50 are configured to receive and retain the cleaning members about the mop head 22 during use. One embodiment for releasably securing the second and third cleaning member 26 and 27 to the mop head 22 is shown in FIG. 3. In this embodiment, four securement structures 50 are configured to receive and retain the second and third cleaning members 26 and 27, which comprise flaps 52 that may be tucked into the securement structures 50 on the mop head 22.

As illustrated in FIGS. 3 and 4, the four securement structures 50 of this embodiment are disposed at the corners of the first side 36 of the hinged platen 34, although these locations may vary depending upon the size and shape of the mop head 22. The securement structures 50 may be formed of a flexible material, such as polyethylene by injection molding, and can be retained within the first side 36 of the hinged platen 34 by a ridge (not shown) disposed within the hinged platen 34, which engages a slot (not shown) disposed on the respective securement structure 50.

Referring once again to FIG. 3, the flexible material of the securement structures 50 includes a central slit 54 transverse to the handle 12 and intersected by a Y-shaped opening 56 defined along three sides by slits which, like the central slit, extend through the flexible material. The configuration as well as the location of the slits on the securement structures 50 may, however, vary. Under the construction shown in FIG. 3, the Y-shaped opening 56 deflects under finger pressure to allow the flaps 52 of the second or third cleaning members 26 and 27 to be pushed through the top surface of the securement structures 50 and into the hinged platen 34. As the second or third cleaning members 26 and 27 are pushed through the top surfaces of the securement structures 50, the slits can engage the cleaning members and hold them in place about the hinged platen 34. As shown in FIG. 4, the second cleaning member 26, may be releasably secured over the first cleaning member 24 through use of the securement structures 50.

Other securement structures may be utilized. Similar to the first cleaning member 24, the second and third cleaning members 26 and 27 may be releasably secured to the hinged platen 34 or over the first cleaning member 24 by clips or hooks. In addition, a hook and loop arrangement, sold under the trademark VELCRO® and available from Velcro USA, Inc. Of Manchester, N.H. may be employed. The Velcro may be disposed on the first side 36 of the hinged platen 34 and on appropriate locations on the second and third cleaning members 26 and 27.

In another aspect, use of the different cleaning members allows one embodiment of the mop of the present invention to be used in a plurality of different modes. First, by securing the first cleaning member 24 directly to the hinged platen 34, the mop 10 of the present invention may be used as a wet mop with wringing capabilities. Second, by securing the second cleaning member 26 over the first cleaning member 24 or directly to the hinged platen 34, the mop 10 of the present invention may be used as a dust mop. Third, by securing the third cleaning member 27 over the first cleaning member 24 or directly to the hinged platen 34, the mop 10 of the present invention may be used as a damp mop. This aspect is convenient for the user, who does not need to purchase separate mops for separate tasks.

Figure 5A:
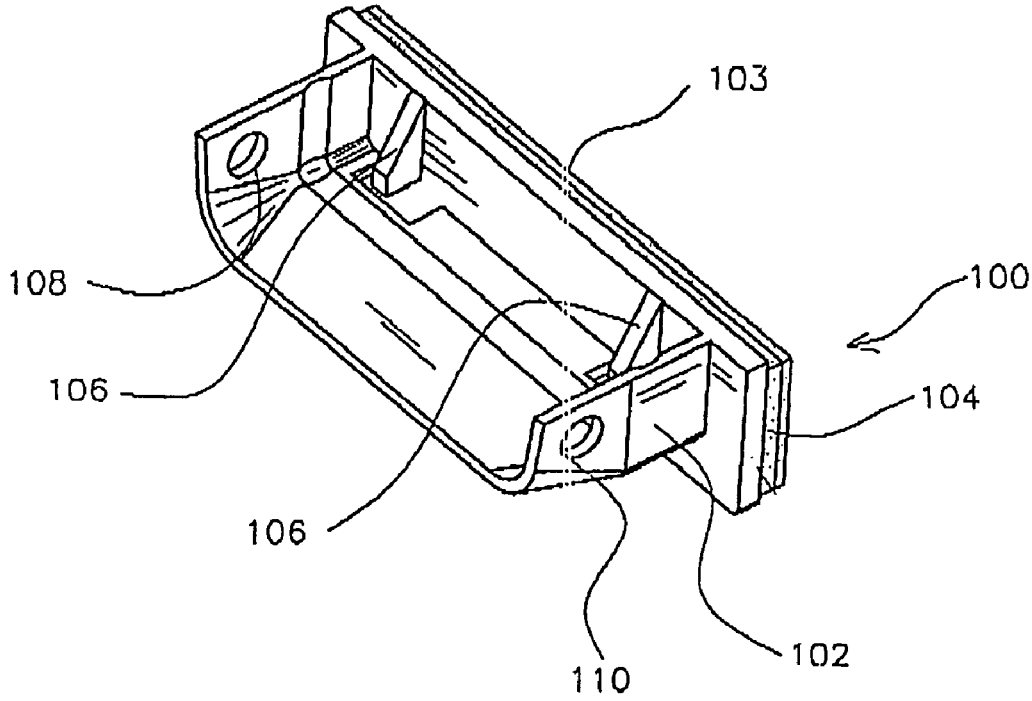
FIG. 5A is a rear perspective view of the scrubber of one embodiment of the mop of the present invention.

In other aspects, a cleaning surface such as a scrubber 100, often utilized for tough ground-in dirt, may be releasably secured to the mop head 22. As shown in FIG. 5A, one embodiment of scrubber 100 comprises a body 102 and an attachment surface 104, which may be VELCRO® or a similar material. The attachment surface 104 is disposed on the front surface of the scrubber 100. Removable surface strips, which may be an abrasive scrubbing pad 103, a polishing pad or a bush, may be attached to the attachment surface 104. The body 102 of the scrubber 100 may be releasably secured to the mop head 22 or formed as a unitary structure integral with the mop head 22.

Figure 5B:
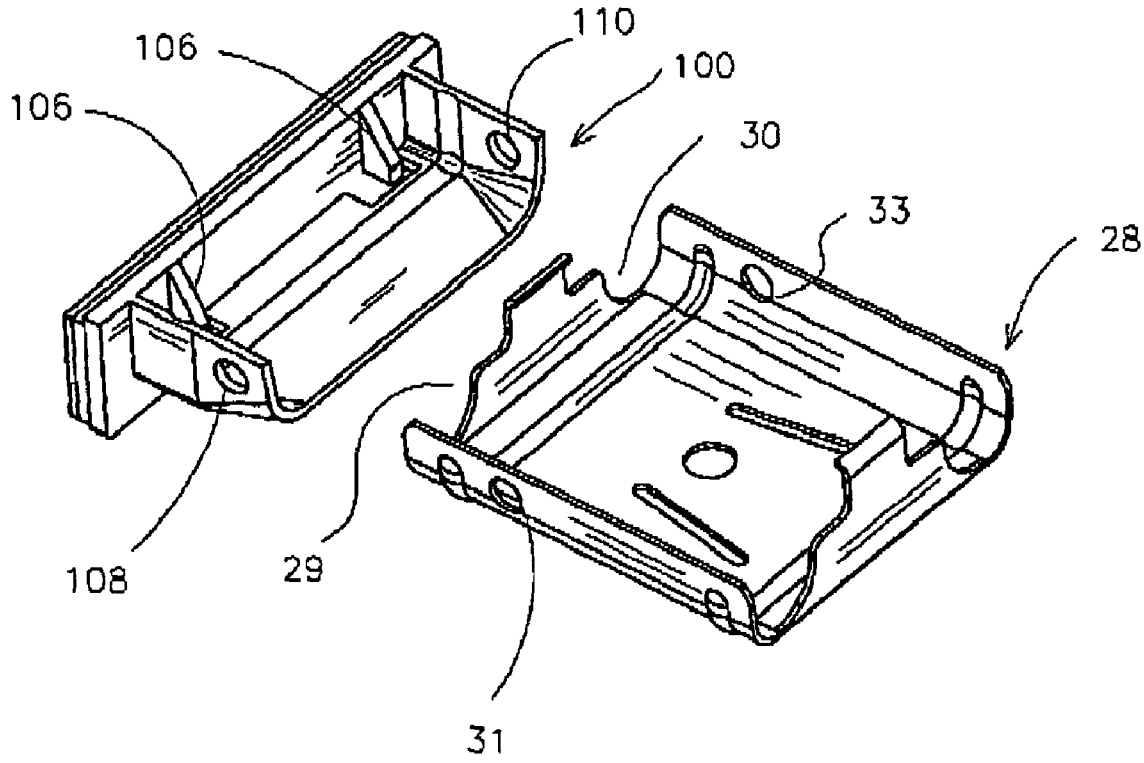
FIG. 5B is a rear perspective view of the scrubber of FIG. 5A lined up for insertion into the mop head support member.

To releasably secure the scrubber 100 to the mop head 22, certain features on the support member 28 and the squeeze member 40 may be utilized. As shown in FIGS. 2 and 5B, the support member 28 comprises two cut-outs 29 and 30 and a first pair of apertures 31 and 33 disposed on opposing sides. The cut-outs 29 and 30 are designed to receive corresponding detent tabs 106 disposed on the body 102 of the scrubber 100, shown in FIGS. 5A and 5B. Referring to FIGS. 2 and 5B, the first pair of apertures 31 and 33 of the support member 28 are designed to receive the pair of opposing arms 42 and 44 of squeeze member 40 which then mate with a second pair of apertures 108 and 110 within scrubber 100.

Scrubber 100 may be attached to mop head 22 by pivoting the opposing plates 46 and 48 of the hinged platen 34 about their common pivot axis, as shown in FIG. 2. The arms of squeeze member 40 are then manually held together, allowing removal of squeeze member 40 from the first pair of apertures 31 and 33 of support member 28. Referring again to FIG. 5B, scrubber 100 is then slid over support member 28 so that the detent tabs 106 of scrubber 100 mate with the cut-outs 29 and 30 of support member 28 and the first pair of apertures 31 and 33 are aligned with the second pair of apertures 108 and 110. Referring now to FIGS. 2 and 5B, opposing arms 42 and 44 of squeeze member 40 are once again manually held together and then reinserted back into support member 28. The ends of the opposing arms 42 and 44 are aligned with the first 31 and 33 and second pair 108 and 110 of apertures and the manual pressure on squeeze member 40 is released, permitting the ends of the opposing arms 42 and 44 to enter the first 31 and 33 and second pair 108 and 110 of apertures. Scrubber 100 is thereby releasably secured to support member 28.

Removal of scrubber 100 may be accomplished by pivoting the opposing plates 46 and 48 of the hinged platen 34 about their common pivot axis A and manually holding the opposing arms 42 and 44 of squeeze member 40 together. Squeeze member 40 is then removed, and the detent tabs 106 of scrubber are slid off of the cut-outs 29 and 30 of support member 28.

Figure 6:
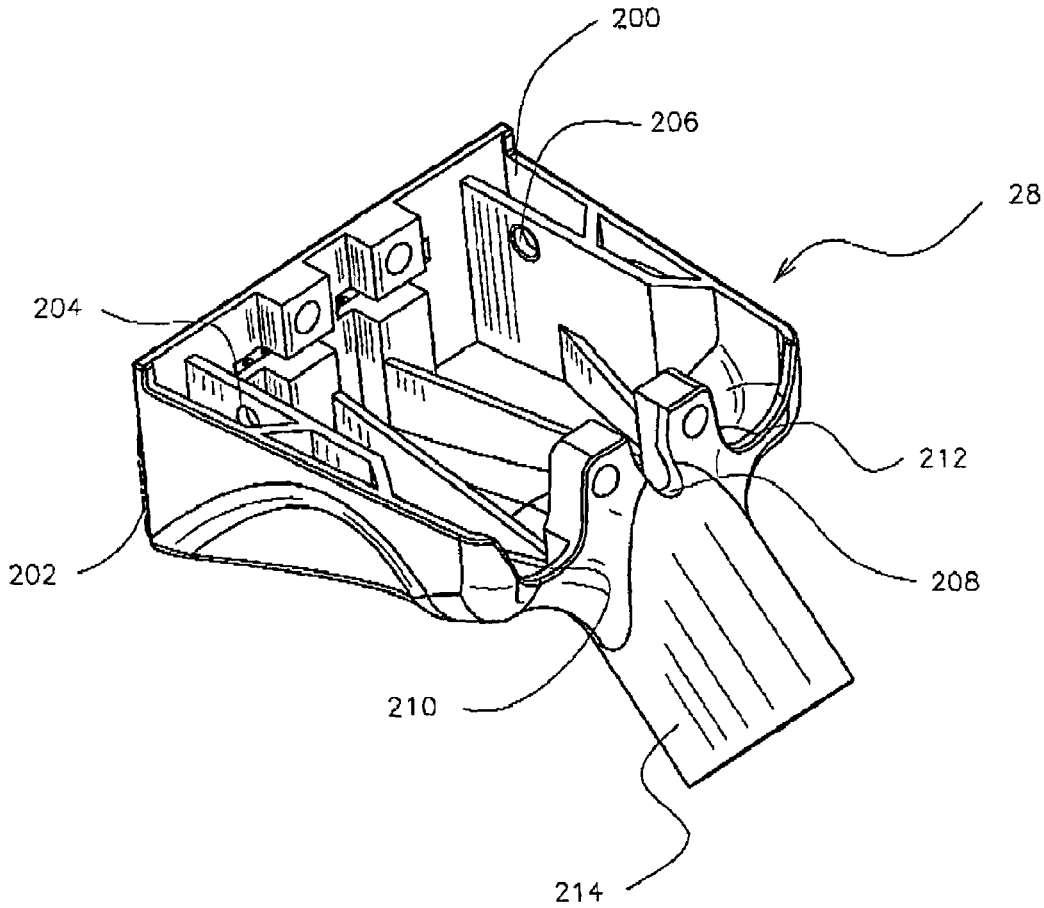
FIG. 6 is a top perspective view of an alternate embodiment of the scrubber and support member of FIGS. 5A and 5B.

In an alternate embodiment, shown in FIG. 6, scrubber 200 and support member 28 are formed as a single component of unitary construction, which can be releasably secured to mop head 22. Typically, the single component is constructed of plastic and fabricated by injection molding.

In this embodiment, support member 28 itself comprises the attachment surface 202. As shown in FIG. 6, opposing sidewalls of support member 28 comprise a pair of opposing apertures 204 and 206. Within support member 28 is a first central channel 208 and second and third side channels 210 and 212. A spring disposed on the first side of mop head 22 may be positioned within the first central channel 208. Support member 28 further comprises an extension 214, which mates with the lower end 16 of the handle 12 of the mop 10 of the present invention. Extension 214 can be designed as an interference fit with handle 12 and may be secured to the mop head 22 through other methods known to those of skill in the art. Referring now to FIGS. 2 and 6, to releasably secure the scrubber 200 of this alternate embodiment to the mop head 22, the opposing arms 42 and 44 of the squeeze member 40 are manually held together and positioned in the second and third side channels 210 and 212 of support member 28 The ends of the opposing arms 42 and 44 are then positioned within the pair of opposing apertures 204 and 206 of the scrubber 200 and released.

In addition to the above-identified ways in which the scrubber and support member are releasably secured to the mop head, other structures may be employed. For example, a bayonet fitting or a T-bar, which are known to those of skill in the art are suitable.

Figure 7A:
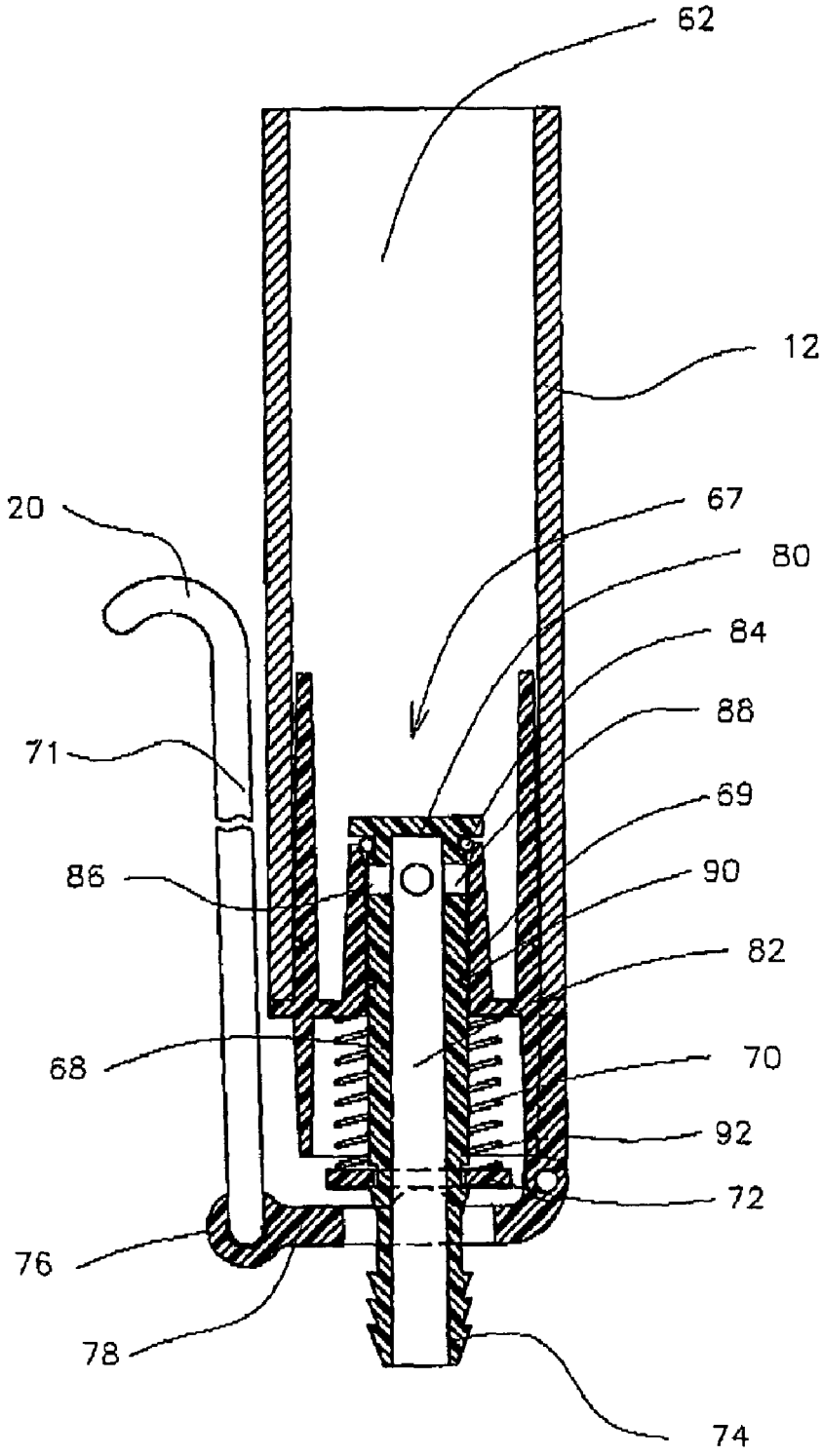
FIG. 7A is a cross-sectional view of the valve assembly of one embodiment of the mop of the present invention, with the valve assembly in its closed position.
Figure 7B:
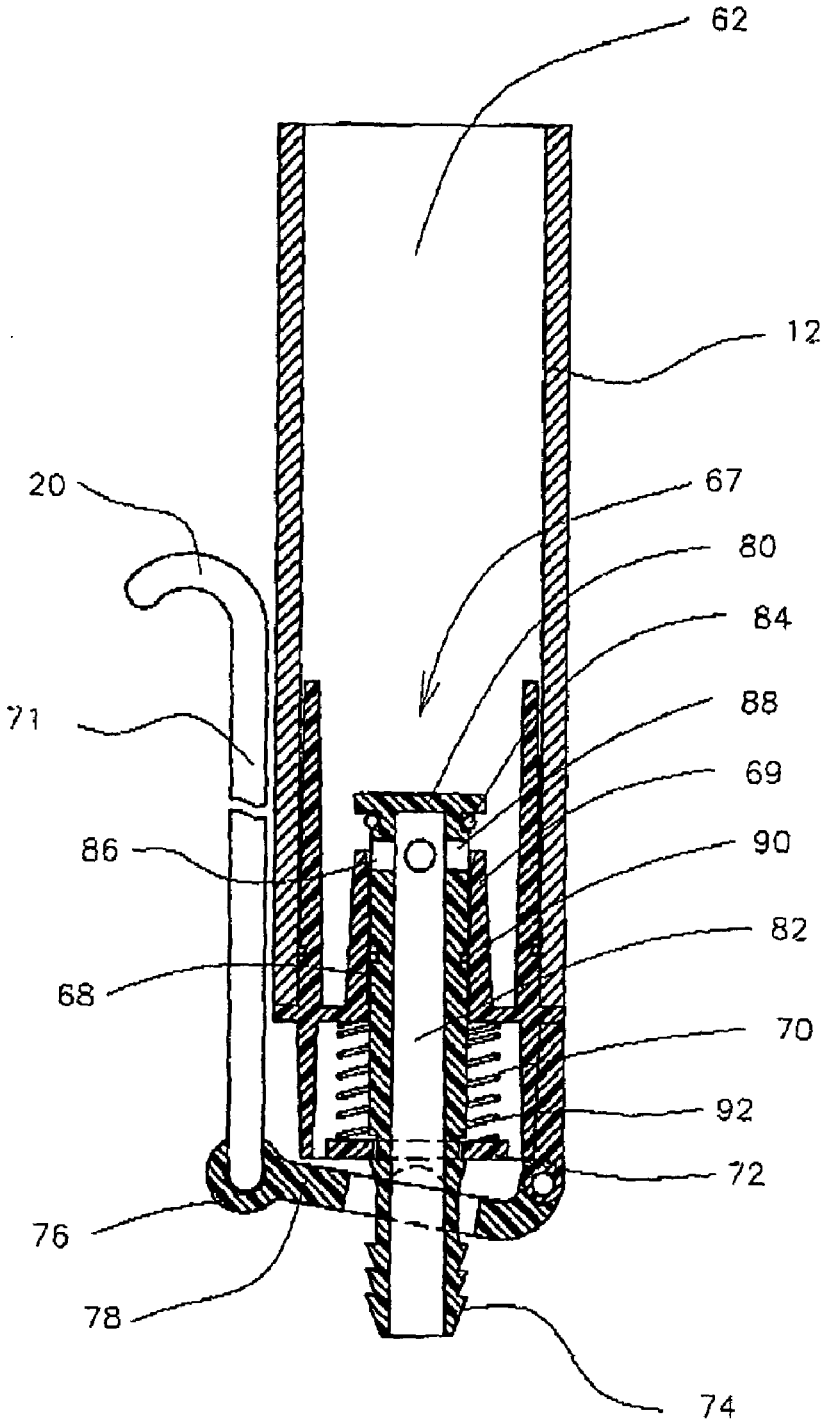
FIG. 7B is a cross-sectional view of the valve assembly of one embodiment of the mop of the present invention, with the valve assembly in its open position.

According to yet another aspect of the present invention, mop 10 may be adapted to hold and release a fluid, such as a cleaning solution. As seen in FIGS. 7A and 7B, the handle 12 comprises a portion adapted to hold a fluid. The portion adapted to hold the fluid is in communication with the lower end 16 of the handle 12 and may take many forms. For example, the portion may comprise a removable container associated with the handle or a container permanently connected to the handle through a tube.

In select embodiments, the portion is in the form of a cavity 62 disposed within the handle 12. Use of the cavity 62 eliminates the need for a removable container for holding the fluid. In turn, this eliminates added costs associated with the manufacture of the removable container. Further, the absence of the separate container, makes the mop easier to handle and maneuver and also facilitates inclusion of a wringing feature, which the removable container may interfere with when it is disposed on the handle. Under this construction, the handle may, in certain embodiments, comprise a substantially uniform cross-section.

Figure 8:
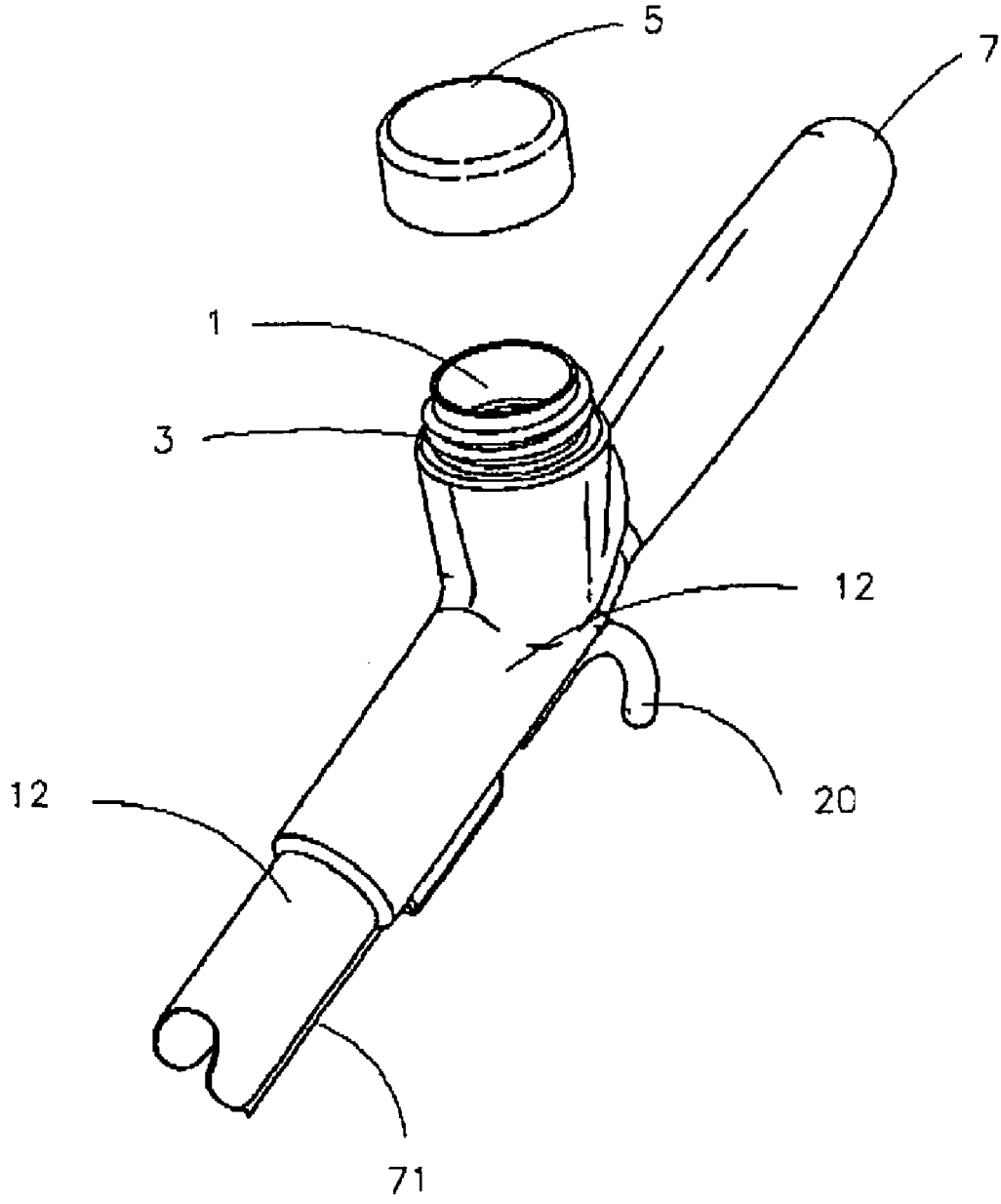
FIG. 8 is a top perspective view of the upper end of the handle of one embodiment of the mop of the present invention.

To fill the cavity 62 with fluid, a user may pour the fluid through an opening 1, disposed on a surface of the handle 12. The opening may be disposed anywhere on the handle 12, including on its top surface 7. As shown in FIG. 8, the opening is disposed on the upper end 14 of the handle 12 and exhibits a threaded outer surface 3, designed to mate with a cap 5 having an opposing threaded inner surface. A sidewall of the cap may comprise at least one depression for gripping the cap. After the user grips and removes the cap 5, a fluid cleaning solution may be poured through opening 1 and into the handle 12. To check the level of the fluid poured into the handle 12, a transparent window (not shown) may be disposed on the handle 12.

In still another aspect of the present invention, the fluid is released through the one or more openings 64, 65 and 66 disposed on the support member 28 or scrubber 100 or 200. As shown in FIG. 3 and 4, six openings 64, 65 and 66 release the fluid. To maximize coverage of the fluid over the cleaning surface, the one or more openings 64, 65 and 66 may be angled in any number of different directions. For example, as shown in FIG. 4, the openings disposed on the right side 64 of the mop head 22 may be angled to the right, the central openings 65 may be untangled and the openings disposed on the left side 66 of the mop head 22 may be angled to the left. As those of skill the art will appreciate, any number of openings disposed in various arrangement and at various angles may be employed.

The fluid is typically released in the form of a spray or stream. One embodiment of the present invention therefore employs a valve assembly for releasing the fluid. Generally, the mop of this embodiment comprises a handle, which includes a portion for holding the fluid. The handle also includes an opening. The mop further comprises a valve assembly for releasing the fluid from the opening in the portion of the handle. The valve assembly itself includes a valve positioned to cover the opening in the portion of the handle, which prevents fluid release. To release the fluid, the valve is movable to a position to uncover the opening.

A more detailed valve assembly for releasing the fluid is shown in FIGS. 7A and 7B. FIG. 7A shows the valve assembly in its closed position. FIG. 7B shows the valve assembly in its open position. As shown in FIGS. 7A and 7B, the valve assembly comprises a hollow valve body 68, an annular sleeve 69 surrounding the hollow valve body 68, a spring 70, a spring retainer 72, a first barbed fitting 74 and a hook 76 and lever arm 78 both of which are associated with a rod 71 connected to the second actuator 20. The hollow valve body 68 may further comprise a flat transverse top surface 80, a central cavity 82, a first O-ring 84, one or more apertures 86 and 88, a second O-ring 90 and an annular shoulder 92.

Figure 9:
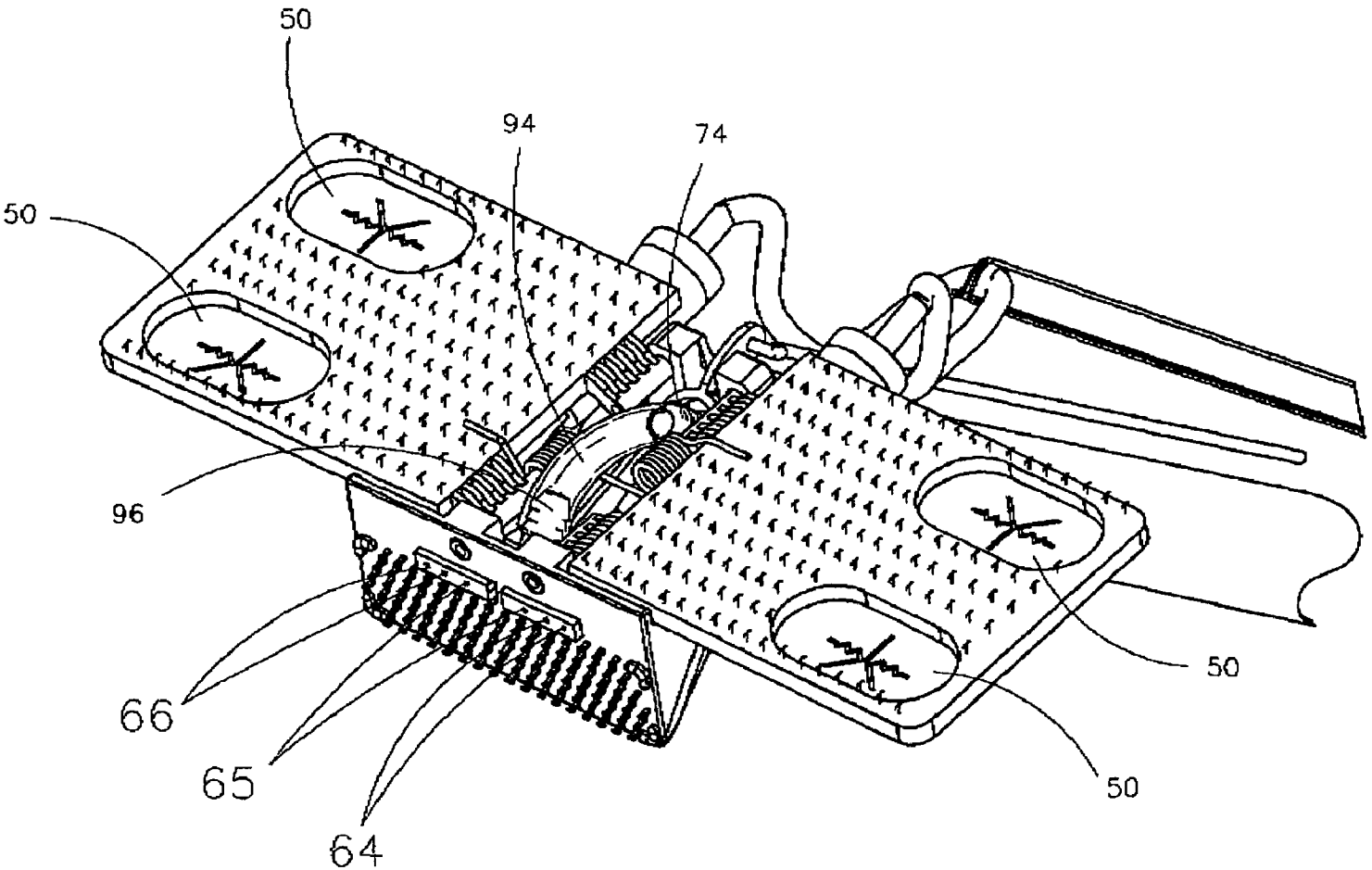
FIG. 9 is a bottom perspective view of the connection between the valve assembly and the one or more openings of one embodiment of the mop of the present invention.

As shown in FIG. 9, the valve assembly 67 may be connected to the one or more openings 64, 65 and 66 through a flexible tube 94 associated with the first barbed fining 74. The opposite end of the flexible tube 94 may be connected to a second barbed fitting 96 associated with a manifold, on the outer surface of which are disposed the one or more openings 64, 65 and 66. As shown in FIG. 9, the flexible tube 94 is angled at 45 degrees to achieve the proper trajectory for releasing the fluid. The flexible tube may, however, exhibit various other angles and configurations.

In operation, the valve assembly 67 is activated by the second actuator 20. As shown in FIGS. 7A and 7B, the second actuator 20 may be disposed near the upper end 14 of the handle 12 and is associated with the valve assembly 67 through a rod 71 connected to the hook 76. In certain embodiments, the second actuator 20 may be a trigger or button that, when activated, opens the valve assembly 67 and releases fluid.

Before activation of the second actuator 20, the valve assembly 67 is maintained in a closed position, as shown in FIG. 7A. When the valve assembly is in this condition, the first O-ring 84, working in conjunction with the annular sleeve 69 creates a seal that prevents fluid from entering the one or more apertures 86 and 88 in the hollow valve body 68. The spring retainer 72 and spring 70 provide tension to maintain the first O-ring 84 in its closed position.

As shown in FIG. 7B, after activation of the second actuator 20, the lever arm 78 is pulled upward, exerting force on the bottom of the spring retainer 72, thereby compressing the spring 70 and moving the spring retainer 72 toward the upper end 14 of the handle 12. Movement of the spring retainer 72 in this direction exerts pressure on the annular shoulder 92, driving the hollow valve body 68 upward and exposing the one or more apertures 86 and 88 to the fluid. Under these circumstances, fluid enters the hollow valve body 68 down through the apertures 86 and 88 and flows into the first barbed fitting 74, through the flexible tube 94 and the second barbed fitting 96, and out the one or more openings 64, 65 and 66 shown in FIG. 9. As fluid flows through the valve assembly 67, the second O-ring 90 creates a dynamic seal that prevents leakage of the fluid from the valve assembly.

The fluid is ultimately released as a spray or stream from the one or more openings 64, 65 and 66 under the force of gravity. Thus, to the extent the handle is full, a larger volume of fluid is released from the one or more openings 64, 65 and 66 through the valve assembly 67. Of course, even if the handle 12 is not completely full of fluid, the valve assembly 67 is capable of releasing fluid from the one or more openings 64, 65 and 66.

Variations, modifications and other implementations of what is described herein will occur to those of ordinary skill in the art without departing from the spirit and scope of the invention. Accordingly, the invention is in no way limited by the preceding illustrative description.

We claim:

1. A mop capable of operating in a plurality of different modes comprising:

a handle including an upper end and a lower end;

a mop head disposed near the lower end of the handle, wherein said mop head includes a cleaning surface;

a plurality of cleaning members comprising a first sponge member, a second dry member, and a third pre-moistened member, wherein each of said first sponge member, said second dry member, and said third pre-moistened member are adapted to be releasably secured to said mop head in a substantially different plane than said cleaning surface; and an actuator adapted to cause compression of a portion of at least one of said plurality of cleaning members, wherein the mop is capable of operating in one of a first mode in which the first sponge member is releasably secured to the mop head and is adapted to clean, a second mode in which the second dry member is releasably secured to the mop head and is adapted to clean, and a third mode in which the third pre-moistened member is releasably secured to the mop head and is adapted to clean.

2. The mop of claim 1 wherein the cleaning surface comprises an abrasive surface.

3. The mop of claim 2 wherein said abrasive surface comprises a scrubber pad.

4. The mop of claim 1 wherein the cleaning surface comprises a separate part attached to said mop head.

5. The mop of claim 1 wherein the cleaning surface is substantially perpendicular to said opposing plates.

6. The mop of claim 1, wherein the handle comprises a portion adapted to hold a fluid.

7. The mop of claim 6, wherein the portion adapted to hold the fluid comprises a cavity within the handle in communication with the lower end of the handle.

8. The mop of claim 6, further comprising one or more openings in communication with the portion of the handle adapted to hold the fluid, the one or more openings capable of releasing the fluid.

9. The mop of claim 8, wherein a tube connects the portion adapted to hold the fluid with the one or more openings.

10. The mop of claim 8, further comprising a valve disposed between the portion to hold the fluid and the one or more openings.

11. The mop of claim 6, further comprising an actuator disposed on the handle and adapted to cause release of the fluid.

12. The mop of claim 6, further comprising a transparent window disposed on the handle for viewing the fluid.

13. The mop of claim 6, further comprising an opening disposed on a surface of the handle adapted to accept the fluid.

14. The mop of claim 13, further comprising a cap adapted to cover the opening.

15. The mop of claim 1, wherein at least one of the first sponge member, second dry member, and third pre-moistened member is disposable.

16. The mop of claim 1, wherein each of said first sponge member, said second dry member, and said third pre-moistened member are adapted to be releasably secured to said mop head through at least one securement structure in the mop head.

17. The mop of claim 1, wherein each of said first sponge member, said second dry member, and said third pre-moistened member are adapted to be releasably secured to said mop head through an attachment selected from the group consisting of clips, pins, and hook and loop arrangements.

18. The mop of claim 1, wherein at least one of the first sponge member, second dry member, and third pre-moistened member is reusable.

19. The mop of claim 1, wherein at least one of the first sponge member, second dry member, and third pre-moistened member is reversible.

20. The mop of claim 1, further comprising a hinged platen disposed on the mop head.

21. The mop of claim 1, further comprising rollers disposed on the mop head.

22. A butterfly mop comprising:

a handle including an upper end, a lower end and a portion adapted to hold a fluid; wherein the portion adapted to hold the fluid does not include a removable container;

an opening disposed on a surface of the upper end of the handle for pouring fluid into the handle;

a mop head disposed near the lower end of the handle, the mop head including a cleaning member comprising at least one of a first sponge member, a second dry member, and a third pre-moistened member, opposing plates rotatably secured about a common pivot axis to converge pivotally toward one another, wherein convergence of the opposing plates compresses a portion of the cleaning member, and a cleaning surface oriented in a substantially different plane than said cleaning member; and one or more openings in communication with the portion of the handle adapted to hold the fluid, the one or more openings capable of releasing the fluid.

23. The butterfly mop of claim 22 wherein the cleaning surface comprises an abrasive surface.

24. The butterfly mop of claim 23 wherein said abrasive surface comprises a scrubber pad.

25. The butterfly mop of claim 22 wherein the cleaning surface comprises a separate part attached to said mop head.

26. The butterfly mop of claim 22 wherein at least one of said first sponge member, second dry member, and third pre-moistened member is adapted to be secured directly to the mop head.

27. The butterfly mop of claim 22 wherein the cleaning member comprises any combination of said first sponge member, second dry member, and third pre-moistened member.

28. The butterfly mop of claim 27 wherein the cleaning member is adapted to be used in a first mode utilizing said first sponge member, a second mode utilizing said second dry member, and a third mode utilizing said third pre-moistened member.

29. The butterfly mop of claim 28 wherein each of said first sponge member, said second dry member, and said third pre-moistened member are adapted to be secured and released from said mop head.

30. The butterfly mop of claim 22 further comprising an actuator adapted to cause compression of a portion of the cleaning member, said cleaning member being releasably secured to the mop head.

31. The butterfly mop of claim 22 further comprising only one valve disposed between the portion adapted to hold the fluid and the one or more openings.

32. The butterfly mop of claim 22, wherein the portion adapted to hold the fluid is a cavity within the handle.

33. The butterfly mop of claim 22, further comprising a valve assembly for releasing the fluid through the one or more openings.

34. The butterfly mop of claim 33, further comprising an actuator for opening the valve assembly and releasing the fluid through the one or more openings.

35. The butterfly mop of claim 33, wherein the valve assembly comprises an O-ring.

36. The butterfly mop of claim 33, wherein the valve assembly further comprises a hollow valve body including an annular shoulder.

37. The butterfly mop of claim 36, wherein the valve body comprises one or more apertures.

38. The butterfly mop of claim 36, further comprising a sleeve positioned over the hollow valve body.

39. The butterfly mop of claim 33, further comprising a barbed fitting in communication with the valve assembly.

40. The butterfly mop of claim 22, further comprising a flexible tube in communication with the one or more openings.

41. The butterfly mop of claim 22 further comprising an actuator for causing the mop head to compress a portion of the cleaning member.

42. The butterfly mop of claim 22, wherein the handle comprises a substantially uniform cross-section.

43. The butterfly mop of claim 22 wherein the cleaning surface is substantially perpendicular to said opposing plates.

44. The butterfly mop of claim 22 further comprising a transparent window disposed on the handle for viewing the fluid.

45. The butterfly mop of claim 22 further comprising a disposable cleaning member adapted to be releasably secured to the mop head over the cleaning member.

46. The butterfly mop of claim 45 wherein the disposable cleaning member is releasably secured directly to the mop through at least one securement structure in the mop head.

47. The butterfly mop of claim 46 wherein the disposable cleaning member is releasably secured to the mop head through an attachment selected from the group consisting of clips, pins, and hook and loop arrangements.

48. The butterfly mop of claim 45 wherein the mop is capable of being used with the disposable cleaning member.

49. The butterfly mop of claim 22 further comprising a reusable cleaning member which is adapted to be releasably secured to the mop head over the cleaning member.

* * * * *